United States Patent [19]

Gulya et al.

[11] Patent Number: 4,985,121

[45] Date of Patent: Jan. 15, 1991

[54] CERAMIC FOAM MEMBER FOR EXTRACTING WATER FROM A PAPER WEB IN A PAPERMAKING MACHINE

[75] Inventors: Thomas G. Gulya, Appleton; Gary V. Schultz, Kimberley; Ronald A. Arnold, Marinette, all of Wis.

[73] Assignee: Appleton Mills, Appleton, Wis.

[21] Appl. No.: 396,131

[22] Filed: Aug. 21, 1989

Related U.S. Application Data

[62] Division of Ser. No. 356,942, May 25, 1989, Pat. No. 4,888,095.

[51] Int. Cl.[5] ..... D21F 1/54

[52] U.S. Cl. ..... 162/352; 162/374; 210/510.1

[58] Field of Search ..... 162/352, 374; 264/44; 210/510.1; 501/80–82

[56] References Cited

U.S. PATENT DOCUMENTS 4,024,212 5/1977 Dove et al. ..... 264/44
4,760,038 7/1988 Kinney, Jr. et al. ..... 501/95
4,808,558 2/1989 Park et al. ..... 264/42
4,871,495 10/1989 Helferich et al. ..... 501/84

OTHER PUBLICATIONS

"Ceramic Foam Offers Surprising Properties", Brockmeyer et al ME, Jul. 1988, pp. 39–41.

*Primary Examiner*—Karen M. Hastings
*Attorney, Agent, or Firm*—Andrus, Sceales, Starke & Sawall

[57] ABSTRACT

A component to be used in a papermaking machine for extracting moistu re from a paper web. The component includes a supporting structure and a water permeable member is mounted on the supporting structure and is adapted to support a paper web. The water permeable member comprises a rigid mass of ceramic foam having a plurality of interconnected cells. The ceramic foam has an air permeability in the range of 10 to 1,000 cubic feet per square foot of surface area per minute and has a density of 5 to 100 lbs/cubic foot. When a pressure differential is applied to the permeable member to the paper web, moisture will be extracted from the web and passes through the permeable member.

11 Claims, No Drawings

CERAMIC FOAM MEMBER FOR EXTRACTING WATER FROM A PAPER WEB IN A PAPERMAKING MACHINE

This is a division of application Ser. No. 07/356,942, filed May 25, 1989, now U.S. Pat. No. 4,888,095.

BACKGROUND OF THE INVENTION

In a typical papermaking process, water is extracted from the paper web or mat in a number of different operations. For example, in the forming section the paper web is conveyed on a forming wire or belt across a series of spaced transversely extending foil blades. Each foil blade is provided with a generally sharp edge facing in an upstream direction and as the paper web passes across the foil blade, a partial vacuum is created between the web and the upper surface of the blade, which draws water from the web. The sharpened edge of the next suceeding blade riding against the lower surface of the wire will scrape and remove the moisture from the wire.

Water is also extracted from the paper web through use of suction or Uhle boxes. The typical suction or Uhle box includes a rigid cover which supports the wire that carries the paper web, and the cover is provided with a plurality of perforations or slots. By drawing a vacuum on the interior of the box, water is drawn from the paper web into the box.

Water extraction can also be achieved by passing the paper web over a perforated roll, while subjecting the web to a pressure differential created by exposing the interior of the roll to a vacuum.

In other papermaking applications, water is extracted from the web by passing the paper web, while sandwiched between a pair of porous belts or wires, around a curved shoe. As the paper web confined between the twin wires passes around the curved surface, a compressive force is exerted along with centrifugal force which tends to drive the water outwardly from the web.

In a dryer section of a typical papermaking machine, the paper web is passed over a series of heated dryer rolls to drive off the moisture, and in some applications, the dryer rolls may be perforated and a pressure differential applied to pass air through the web to facilitate the drying operation.

The water extracting media, such as suction and Uhle box covers, perforated drums, and the like are generally composed of rigid plastic, metal, or solid ceramic and slots, holes or grooves are machined in the material. With this type of construction, the holes or slots are relatively large in size and when the material in use is subjected to a pressure differential, the fiber material of the paper web can be drawn into the holes or slots, causing fiber misorientation in the web. A further disadvantage is that the relatively large sized openings, i.e. holes and/or slots, tend to shadow mark the web, which would make the paper unsuitable for certain applications. Moreover, in the conventional water extraction operation, the pressure differential is applied only through the openings and consequently, the water drainage at any particular instant is through isolated areas of the web, which results in non-uniform water extraction.

SUMMARY OF THE INVENTION

The invention is directed to an apparatus for extracting moisture from a wet paper web in a papermaking machine. The apparatus includes a supporting structure and a water permeable member is mounted on the supporting structure and a paper web, supported on a moving porous belt, passes over the water permeable member. A pressure differential can be applied to the web as it travels over the water permeable member to aid in extracting water from the web, and the extracted water drains through the water permeable member.

The water permeable member is composed of a rigid mass of porous ceramic foam material containing a plurality of interconnected cells. The ceramic foam material has an air permeability in the range of 10 to 1000 cubic feet per square foot of surface area per minute, a compressive strength greater than 100 psi, and a density in the range of 5 to 150 lbs/cu.ft.

The permeable member is fabricated by initially producing a polymeric foam element having the same configuration as the permeable member. The polymeric foam can take the form of open cell polyurethane foam.

The polyurethane foam substrate is then coated with a liquid slurry of a ceramic material, and after draining the excess ceramic material from the substrate, the substrate is subjected to an elevated temperature, sufficiently high to burn off the polymeric material and at the same time fire the ceramic material, thereby resulting in a fired ceramic structure composed of a latticework of interconnected cells. The resulting ceramic foam material has a predictable porosity, similar to that of the polyurethane substrate.

The ceramic foam member has a relatively fine uniform porosity throughout its entire surface area, thereby eliminating the possibility of forming shadow marks on the paper web, as can occur when water is extracted from the web through larger-sized holes or slots.

With the fine porous structure, larger particles and fibers cannot penetrate the pores, so that the machine will run cleaner and maintenance will be reduced. Moreover, due to the fine porous structure, there will be a lesser tendency to draw fibers into the pores, thus minimizing fiber disorientation in the paper web.

The ceramic foam member has a high compressive strength and thus can be fabricated into articles, such as roll shells and shoes, which are subjected to a high compressive stress during the papermaking operation. As the ceramic material has high temperature resistance, the ceramic foam can be fabricated into dryer drum shells, which may be exposed to elevated temperatures during operation.

Since the ceramic foam material has a substantially lesser weight than metal, the supporting structures for the ceramic foam material can be reduced in size and when used as a roll shell, a lesser driving force is required for rotation of the shell due to the reduction in weight.

The ceramic foam material is also resistant to chemicals, so that there is virtually no possibility of deterioration of the ceramic foam member through exposure to the papermaking chemicals.

Other objects and advantages will appear in the course of the following description.

DESCRIPTION OF THE PREFERRED EMBODIMENT

The invention is directed to an article to be used in a water extracting application in the forming section, press section or dryer section of a papermaking machine. As an example, in the forming section of a typical papermaking machine a cellulosic slurry is contained within a headbox and is discharged from the box onto an endless moving forming wire or belt in the form of a mat or web. Located immediately downstream from the headbox is a forming board which extends transversely across the width of the machine. In addition, a series of spaced foil blades are positioned downstream of the forming board and the foil blades are followed by a group of suction boxes. As the paper web is conveyed over the foil blades and suction boxes by the forming wire, water is extracted from the web in a conventional manner.

In the typical installation, the foil blades each include a generally sharp edge which faces in an upstream direction and rides against the lower surface of the forming wire. As the wire carrying the paper web passes over the upper surface of the foil blade, a partial vacuum is created between the paper web and the foil blade, which acts to draw water downwardly from the web, and a portion of the water tends to collect on the undersurface of the wire. The sharpened edge of the next succeeding foil blade will ride against the undersurface of the wire to strip the moisture from the wire.

The typical suction box includes an open-top housing and a perforated or water permeable cover which supports the moving forming wire and paper web. The interior of the suction box is connected to a source of subatmospheric pressure or vacuum and the vacuum drawn through the cover acts to draw water from the paper web.

In accordance with the invention, a porous ceramic foam material is used to construct the permeable water extracting members in the papermaking machine, such as vacuum box covers, and can also be used to produce normally non-porous members, such as foils and forming boards. By constructing the forming board and foils of the porous ceramic foam material, additional water extraction can be achieved.

In addition, the porous ceramic foam material can be employed in producing shoes, cylindrical press roll shells, cylindrical dryer roll shells, Uhle box covers, and other water extracting components used in a papermaking machine.

The ceramic foam material is a rigid open cell type that has an air permeability of 10 to 1,000 cubic feet per square foot of surface area per minute, a density in the range of 5 to 150 lbs/cubic foot. and a compressive strength in excess of 100 psi. The ceramic foam material has a bulk density in the range of 10 to 50% of the theoretical density of the ceramic.

The ceramic foam is a complex pattern of dodecahedra, which is repeated in three dimensions. The dodecahedra are defined by ceramic filaments which outline the edges of the pores or cells.

The ceramic foam article is constructed by initially producing a substrate of polymeric foam that is identical in configuration to the ceramic foam article to be subsequently produced. The polymeric foam is preferably polyurethane foam and is an open cell type being composed of a plurality of interconnected cells. After the polymeric foam is formed into the desired shape, it is impregnated with a liquid ceramic slurry, preferably an aqueous slurry. The ceramic material can take the form of sintered aluminum oxide, magnesium oxide, zirconium oxide, zirconium/aluminum oxide, chromium/aluminum oxide, mullite, cordierite, silicon carbide, or the like.

After the entire internal cell structure of the polymeric foam has been coated with the ceramic slurry, the excess slurry is removed as by squeezing, thereby leaving a ceramic coating on all of the internal and external surfaces of the foam.

The coated foam substrate is then subjected to an elevated firing temperature above the temperature to decompose the polymeric foam and sufficient to fire the ceramic material. In general, the firing temperature will be in the range of 1000° F. to 4000° F., with the specific temperature depending upon the ceramic material being used. After firing, a rigid porous mass of ceramic material is produced having a lattice-work of interconnected cells with a porosity similar to that of the original polymeric foam material.

In operation, the wet paper web is carried through the sections of a typical papermaking machine succesively by a forming wire, a papermaker's felt, and a dryer felt. As the paper web, carried by the wire or felt, passes over the water extracting component formed of foam ceramic material, a pressure differential can be applied to the web, causing water to be extracted from the web and the water drains through the porous ceramic foam material.

As the ceramic foam material has a fine porous structure, harsh pull-down of the fibers into the water drainage openings, as occurs in conventional papermaking machines, is eliminated. As an additional advantage, larger particles and fibers cannot penetrate the fine porous structure, so that the machine runs cleaner and requires less maintenance.

As the ceramic foam material has a high compressive strength it can be used to produce articles or components which are subjected in use to relatively high compressive stress, such as press roll shells, dryer roll shells and shoes.

Moreover, the fine porous structure eliminates the possibility of shadow marking on the paper web, as can occur with a conventional water extraction medium having larger sized holes or slots.

Further, because of the more effective dewatering achieved by the medium of the inventon, the overall size of the papermaking machine is reduced.

Various modes of carrying out the invention are contemplated as being within the scope of the following claims particularly pointing out and distinctly claiming the subject matter which is regarded as the invention.

I claim:

1. In a papermaking machine, a liquid permeable member having a surface disposed to support a moving fibrous web containing liquid, said member being composed of a rigid mass of ceramic foam material having a plurality of interconnected cells, said material having an air permeability in the range of 10 to 1,000 cubic feet per square foot of surface area per minute, and a compressive strength greater than 100 psi.

2. The apparatus of claim 1, wherein said ceramic foam material has a bulk density of 10% to 50% of the theoretical density of the ceramic.

3. The apparatus of claim 1, wherein said ceramic foam material has a bulk density of 5 to 150 lbs./cubic ft.

4. The apparatus of claim 1, and including means for applying a pressure differential between an upper surface of the web and a lower surface of said liquid permeable member to extract liquid from said web and into said member.

5. The apparatus of claim 4, wherein said means for applying a pressure differential comprises means for applying a sub-atmospheric pressure to the lower surface of the liquid permeable member.

6. The apparatus of claim 1, wherein said ceramic material is selected from the group consisting of sintered aluminum oxide, magnesium oxide, zirconium oxide, zirconium/aluminum oxide, chromium-/aluminum oxide, mullite, cordierite, silicon, carbide, and mixtures thereof.

7. The apparatus of claim 1, and including a moving porous member disposed to travel on said surface of said liquid permeable member, said porous member supporting said web.

8. An apparatus to be used in a papermaking machine for extracting water from a paper web, comprising an endless moving porous member to support a wet paper web, and a rigid water permeable member having a surface disposed to support said moving porous member and composed of a rigid mass of ceramic foam material having a plurality of interconnected cells, said material having a permeability in the range of 10 to 1,000 cubic feet per square foot of surface area per minute, a compressive strength greater than 100 psi, and a bulk density of 5 to 150 lbs./cubic foot.

9. The apparatus of claim 8, wherein said surface is flat.

10. The apparatus of claim 8, wherein said surface is curved.

11. The apparatus of claim 8, and including means for applying a pressure differential to opposite surfaces of the web as the web and said porous member pass over said water permeable member to thereby extract water from said web.

* * * * *